US005899601A

United States Patent [19]

Yamaguchi et al.

[11] Patent Number: 5,899,601

[45] Date of Patent: May 4, 1999

[54] ELECTROPHOTOGRAPHIC COPYING APPARATUS WITH COMPONENT UNITS IN A VERTICAL ARRANGEMENT

[75] Inventors: Isao Yamaguchi, Utsunomiya; Takashi Kodama, Mooka; Sunao Yamasaki, Ikoma; Hiromi Okuzono, Moriguchi, all of Japan

[73] Assignee: Matsushita Electric Industrial Co., Ltd., Osaka, Japan

[21] Appl. No.: 08/945,466

[22] PCT Filed: May 20, 1996

[86] PCT No.: PCT/JP96/01320

§ 371 Date: Nov. 14, 1997

§ 102(e) Date: Nov. 14, 1997

[87] PCT Pub. No.: WO96/36907

PCT Pub. Date: Nov. 21, 1996

[30] Foreign Application Priority Data

May 19, 1995 [JP] Japan ..... 7-120989
May 15, 1996 [JP] Japan ..... 8-120045

[51] Int. Cl.[6] ..... G03G 15/00; G03G 21/16

[52] U.S. Cl. ..... 399/110; 399/111; 399/118

[58] Field of Search ..... 399/107, 110, 399/113, 118, 119, 130, 111

[56] References Cited

U.S. PATENT DOCUMENTS

| | | | |
|---|---|---|---|
| 4,335,950 | 6/1982 | Gunzelmann et al. . | |
| 5,073,801 | 12/1991 | Haneda et al. . | |
| 5,778,284 | 7/1998 | Kumar et al. | 399/111 |
| 5,809,377 | 9/1998 | Chiesa et al. | 399/111 |

FOREIGN PATENT DOCUMENTS

| | | |
|---|---|---|
| 60-59591 | 3/1980 | Japan . |
| 57-130055 | 8/1982 | Japan . |
| 61-277969 | 12/1986 | Japan . |
| 62-99056 | 6/1987 | Japan . |
| 62-170944 | 10/1987 | Japan . |
| 62-188777 | 12/1987 | Japan . |
| 63-58367 | 3/1988 | Japan . |
| 63-193161 | 8/1988 | Japan . |
| 63-168444 | 11/1988 | Japan . |
| 64-64932 | 3/1989 | Japan . |
| 1-69241 | 5/1989 | Japan . |
| 1-195462 | 8/1989 | Japan . |
| 2-87880 | 3/1990 | Japan . |
| 3-89368 | 4/1991 | Japan . |
| 3-175459 | 7/1991 | Japan . |
| 3-239266 | 10/1991 | Japan . |
| 4-269767 | 9/1992 | Japan . |
| 4-371964 | 12/1992 | Japan . |
| 5-66621 | 3/1993 | Japan . |
| 7-281580 | 10/1995 | Japan . |

OTHER PUBLICATIONS

Shokichi Sugiura "Latest edit. Plastic Molding Technology Encyclopedia—Appendix Recycle Technology–", Jan. 15, 1994 (Jan. 15, 1994), Nikkan Koyo Shimbun Ltd., pp. 17–20.

*Primary Examiner*—S. Lee
*Attorney, Agent, or Firm*—Wenderoth, Lind & Ponack, L.L.P.

[57] ABSTRACT

In an electrophotographic copying apparatus, component units are disposed in a vertical arrangement so that the electrophotographic copying apparatus can be made more compact, lighter in weight and shorter in copying time. An image processing and conveyance unit has a sheet feeder unit, an image processing unit and a fixing-and-discharge section placed generally vertically in this order from below. A developing unit of an image processing unit is retained by a unit retaining portion formed into a generally U shaped cross section and erected on both sides of one end of a base, and by a resin frame having pillar portions integrally formed at the other end. An exposure optical unit is fitted to an upper end portion of the resin frame, and the image processing and conveyance unit is so arranged that its top portion is located in a place out of the region of scanning by a reflecting apparatus of the exposure optical unit. Thus, the whole apparatus can be made compact and shorter in the conveyance distance of sheets.

13 Claims, 10 Drawing Sheets

ELECTROPHOTOGRAPHIC COPYING APPARATUS WITH COMPONENT UNITS IN A VERTICAL ARRANGEMENT

TECHNICAL FIELD

The present invention relates to electrophotographic copying apparatuses such as copying machines

BACKGROUND ART

In recent years, electrophotographic copying apparatuses have been receiving demands for smaller size, saved space and higher speed.

A conventional electrophotographic copying apparatus is explained below in conjunction with the drawings In FIG. 6, there is disclosed an electrophotographic copying apparatus which comprises a first unit 111, a second unit 112, a third unit 113 and a control panel 114, wherein the first unit, the second unit and the third unit are stacked one on another The first unit includes optical elements such as an exposure lamp 115, reflecting mirrors 116 and lenses. The second unit includes a photosensitive drum 117, a developing device 118, a cleaning device 119, a transfer device 120, a fixing device 121 and the like. The third unit includes a sheet feeder 122. The second unit and the third unit can be pulled out rightward in the figure, so that the electrophotographic copying apparatus is small-sized and space-saving, while keeping easy in maintenance and jam-processing (Japanese Laid-Open Patent Publication No. 4-371964).

These photosensitive drum, developing device and cleaning device of the electrophotographic copying apparatus are so arranged that a developing roller 124, the photosensitive drum 117 and the cleaning device 119 are integrated into a developing frame 123 as shown in FIG. 7 so as to be used as fittable to and removable from the copying apparatus Reference numeral 125 denotes a drum shaft, 126 denotes a side plate and 127 denotes a development cover 127 (Japanese Patent Publication No. 60-59591).

However, in the above conventional constitution, the first unit includes the optical elements is equal in vertical size for all parts, such that the box dimensions of the unit depends on the way the optical components are placed, with the result that even if useless space is involved, the unit would be stacked on as it is. The second unit is given as an image-formation processing unit, whereas fixing device is also arrayed horizontally besides the photosensitive drum, the developing device and the cleaning device, such that the unit size is lengthened in the direction of array, inevitably causing the whole apparatus to increase in size. Therefore, because a fed sheet is conveyed along the array of the image-formation processing unit, the conveyance path would become long, resulting in longer copying time.

Furthermore, because the image-formation processing unit including the development frame is weighty, the component members involved are arranged so as to be retained by metallic side plates in order to meet the weighty article and the placement relationship that requires an accurate positioning Therefore, the whole second unit would be heavy, such that the whole apparatus would also be heavy.

The present invention has been accomplished to solve the foregoing issues, and an object of the invention is to provide an electrophotographic copying apparatus which is made more compact and shorter in copying time by disposing its component units vertically, and moreover which is reduced in weight by incorporating a resin frame molding

DISCLOSURE OF INVENTION

In order to achieve the aforementioned object, an electrophotographic copying apparatus according to the present invention is characterized in that the electrophotographic copying apparatus includes an exposure optical unit including a document plate glass for placing thereon a document to be copied, a first reflecting apparatus which is disposed below the document plate glass so as to scan the document placed on the document plate glass, a second reflecting apparatus which moves at a speed ½ that of the first reflecting apparatus, and a lens which is designed to project the document scanned by the first and second reflecting apparatuses onto a photosensitive drum The electrophotographic copying apparatus also includes an image processing unit having a charging device, an exposure slit, a developing device, a transfer device and a cleaning device provided around the photosensitive drum so as to visualize an optical image projected from the lens. The electrophotographic copying apparatus also includes a sheet feeder section which is designed to feed a sheet to the transfer device of the image processing unit, and a fixing-and-discharge section which is designed to fix and discharge the sheet onto which the image has been transferred The sheet feeder section, the image processing unit and the fixing-and-discharge section are arranged generally vertically in this order from below so as to implement an image processing and conveyance unit, and a top portion of the vertically arranged image processing and conveyance unit is located at a place which is below a region of scanning by the first reflecting apparatus of the exposure optical unit and which is out of a region of scanning by the second reflecting apparatus.

The electrophotographic copying apparatus is also characterized in that the image processing unit is located at a place which is below a region of scanning by the first reflecting apparatus and which is adjacent to the lens and the third reflecting apparatus out of a region of scanning by the second reflecting apparatus.

Further, in the electrophotographic copying apparatus, unit retaining portions and an integral resin frame are provided. The unit retaining portions are erected on both sides of one end of a base and each have an engaging portion formed to retain the image processing unit and have a generally U shape in cross section. The integral resin frame includes a plurality of pillar portions disposed on the other end of the base. The image processing unit is mounted to the unit retaining portions of the resin frame, while the exposure optical unit is mounted to upper end portions of the unit retaining portions and upper end portions of the pillar portions in the resin frame.

Also to achieve the aforementioned object, an electrophotographic copying apparatus according to the present invention is characterized in that the electrophotographic copying apparatus includes an exposure-optical-system-containing casing containing at least movable parts of an exposure optical system; an apparatus body casing to which a developing unit is removably fitted; and a sheet feeder cassette. The exposure-optical-system-containing casing, the apparatus body casing and the sheet feeder cassette are arranged so as to be stacked from above to below. The electrophotographic copying apparatus also includes an opening/closing casing in which a transfer device and a fixing device are disposed in a front of the apparatus body casing. The apparatus body casing has a base, left and right side walls, and front and rear leg walls projected downward from front and rear sides. These members are integrally molded of resin. The exposure-optical-system-containing casing is mounted to upper end surfaces of the left and right side walls, a lower end portion of the opening/closing casing is pivotally supported to the front leg wall, and the sheet feeder cassette is insertably and removably accommodated in the guide grooves formed at inner peripheries of the front and rear leg walls.

With the above constitution, the image processing unit is arranged into a compact, vertical array so that the sheet conveyance path becomes short. Moreover, the image processing unit can be placed at a location which is below the region where the first reflecting apparatus makes a scan and which is adjacent to the lens and the third reflecting apparatus where the second reflecting apparatus makes no scan, so that dead space of exposure optical units can be effectively utilized for the stacking of the units.

Also, with the use of the resin frame, a support base for each unit can be easily provided, while the weight of the whole apparatus can be reduced.

BRIEF DESCRIPTION OF DRAWINGS

These and other objects and features of the present invention will become apparent from the following description taken in conjunction with the preferred embodiments thereof with reference to the accompanying drawings, in which.

BEST MODE FOR CARRYING OUT THE INVENTION

Figure 1:
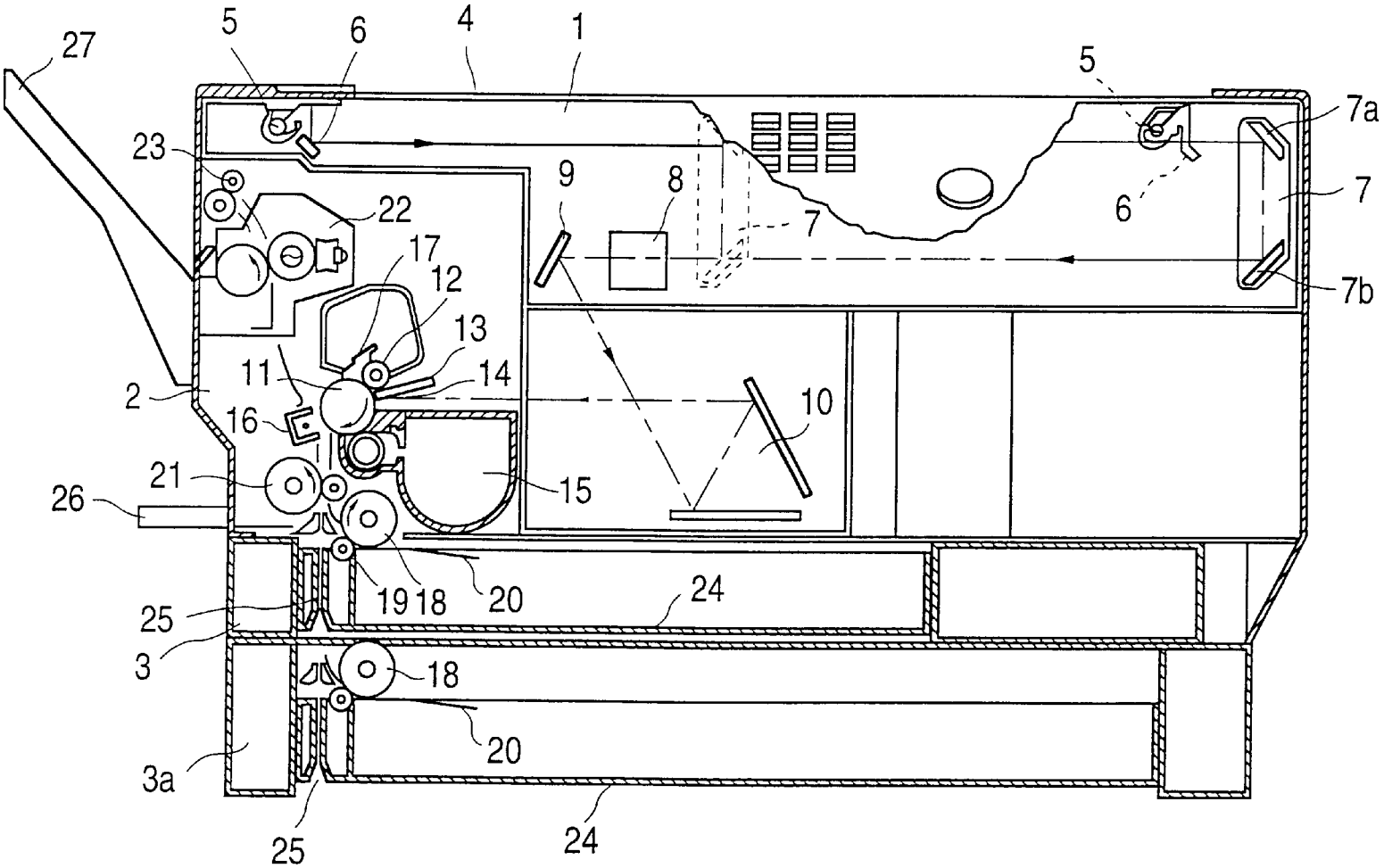
FIG. 1 is a sectional view showing the constitution of an electrophotographic copying apparatus in a first embodiment of the present invention.

Before the description of the present invention proceeds, it is to be noted that like parts are designated by like reference numerals throughout the accompanying drawings A first embodiment of the present invention is described hereinbelow with reference to FIGS. 1 to 5.

FIG. 1 shows an electrophotographic copying apparatus having a constitution according to the first embodiment of the invention. The apparatus includes an exposure optical unit 1, an image processing unit 2 for forming an image through exposure by the exposure optical unit 1, and a sheet feeder unit 3 for conveying a sheet to the image processing unit 2. The exposure optical unit 1, image processing unit 2, and sheet feeder unit 3 may be provided either integrally or separately In particular, the sheet feeder unit 3 is made up of a plurality of different sheet feeder cassettes 3*a* stacked in different sheet sizes The exposure optical unit 1 includes a first reflecting apparatus implemented by a lamp 5 and a first reflecting mirror 6 which are moved under a platen glass 4 to scan a document and a second reflecting apparatus 7 implemented by second reflecting mirrors 7*a,* 7*b* which move at a speed ratio of ½ relative to the first reflecting means; a lens 8 for projecting a scanned document image onto a photosensitive drum 11; third reflecting means implemented by a third reflecting mirror 9 which is so arranged that the document image that has passed through the lens is bent downward so as to be led to the photosensitive drum 11; and the like. It is noted that reference numeral 10 denotes reflecting mirrors which are provided to intervene and project onto the photosensitive drum 11 the document image derived from the third reflecting mirror 9.

The image processing unit 2, which has a photosensitive drum 11 as well as a charging device 12, a side eraser 13, an exposure slit 14, a developing device 15, a transfer device 16, a cleaning device 17 and the like disposed therearound, forms a toner image on the photosensitive drum 11 by common electrophotographic method in correspondence to a document image obtained through exposure, and transfers the toner image onto the sheet that has been fed up. Before the transfer section where the photosensitive drum and the transfer device are opposed to each other, are disposed a pair of registration rollers 21 for stopping a sheet 20, at its leading end, that is fed one by one by a feed roller 18 and a separation roller 19 of the sheet feeder unit 3, and for registering the sheet end and adjusting the timing at which the sheet is fed in. In turn, a fixing device 22 for performing a fixing process on the sheet 20 after the transfer, and a pair of discharge rollers 23 for discharging the sheet fed out from the fixing device 22, are provided downstream of the transfer section.

The sheet conveyor system of these components is provided in a unit having a construction which is openable/closable at a boundary of the sheet conveyance system so that jam processing can be easily attained.

The sheet feeder unit 3 is made up of a sheet feeder cassette 24 in which a different size of sheets 20 are accommodated, and a sheet path 25. Stacking this sheet feeder unit in various sheet sizes makes it possible to implement sheet feeding ready for the various sheet sizes.

Reference numeral 26 denotes a manual feed tray, and 27 denotes a discharge tray.

The exposure scanning of the document is started by the first reflecting apparatus of the lamp 5 and the first reflecting mirror 6, beginning with the left end in FIG. 1. When this occurs, the second reflecting apparatus 7 composed of the second reflecting mirrors 7*a*, 7*b* starts to move from a right proximate position of the lens 8 away from the first reflecting apparatus. At the time when the exposure scanning process is completed, the first reflecting apparatus and the second reflecting apparatus come to a state of proximity to each other at the right end.

The exposure optical unit 1 includes one part smaller in vertical size and another part larger in vertical size, in the front and rear along the scanning direction, respectively. The region on the left side of FIG. 1 where only the first reflecting apparatus scans has a smaller vertical size, while the region on the right side where both the first reflecting apparatus and the second reflecting apparatus scan needs to include a region for optical axes of reflection, with lenses also disposed, thus being larger in the vertical size. Besides, the exposure optical unit 1 is formed into a box shape having a step gap in the vertical size, its bottom surface and side surfaces being made of metal plates, with the platen glass 4 placed thereon. Further, at the bottom surface portion, fourth reflecting mirrors 10 are disposed within the casing, so that an optical image that has passed through the lens 8 and been bent by the third reflecting mirror 9 will be bent generally horizontal by the fourth reflecting mirrors 10 and led to the exposure slit 14 of the photosensitive drum 11 Although this casing is fitted to the bottom surface of the exposure optical unit 1, the casing may also be provided integrally with the exposure optical unit or provided so as to be removable.

The image processing unit 2 is constructed so as to be removably retained to the resin frame made from a resin material such as glass-containing polycarbonate.

Figure 2:
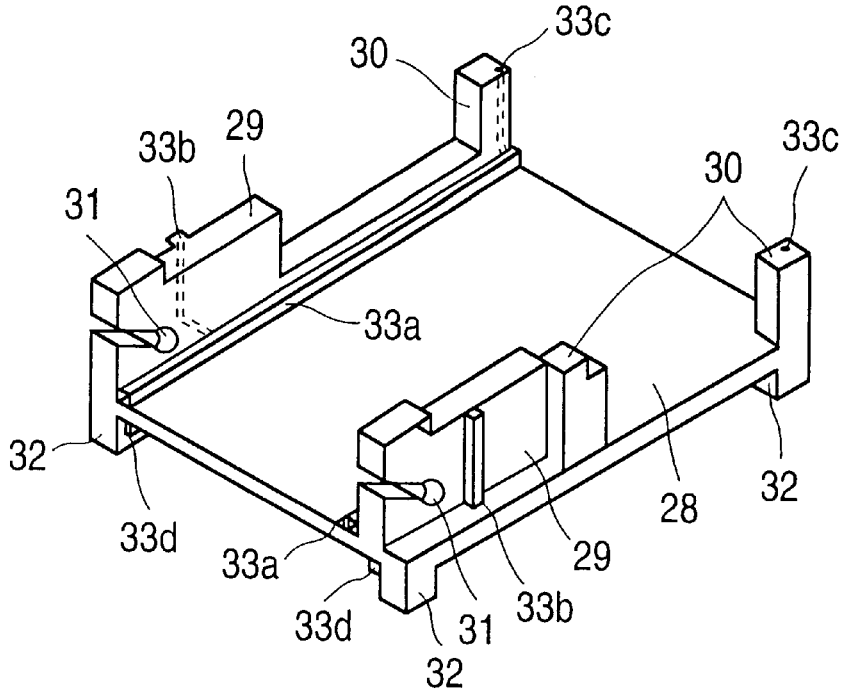
FIG. 2 is a perspective view showing the constitution of a resin frame in the first embodiment of the present invention.
Figure 3:
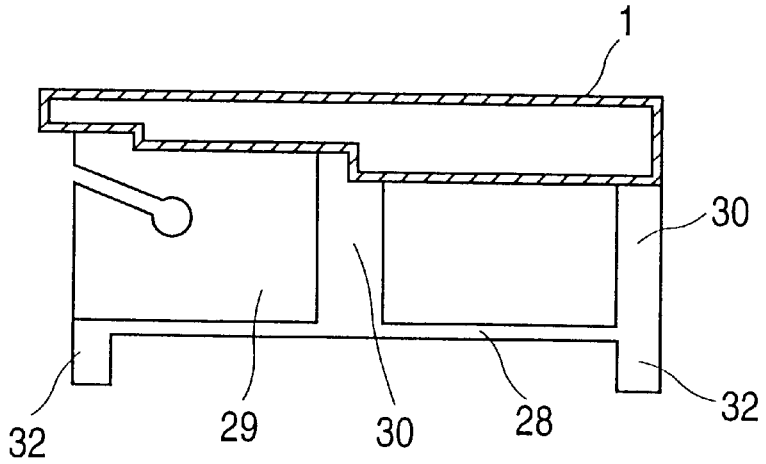
FIG. 3 is a sectional view showing a constitution in which an exposure optical unit is fitted to the resin frame in the first embodiment of the present invention.

The resin frame is so constructed, as shown in FIG. 2, that side walls 29 are vertically erected on both sides of one end of a base 28 while a plurality of pillar members 30 are disposed at the other end, where these members are integrally resin molded. Reference numeral 31 denotes engaging holes formed in the side walls 29, serving each as a unit retaining portion for engaging and retaining the image processing unit 2. Whereas the resin frame is molded into a generally U shape in cross section, legs 32 may be molded integrally as required. Reference numerals 33*a* to 33*d* denote gas grooves, which will be described later. The exposure optical unit 1, as shown in FIG. 3, is placed and fixed on upper end portions of the side walls 29 serving each as a unit retaining portion for the resin frame as well as on upper end portions of the plurality of pillar members 30.

The resin frame is now explained in detail with reference to FIG. 2. The frame to be used in the electrophotographic copying apparatus of the first embodiment of the invention is made by integral molding of resin, where for the molding of such a resin structure that is relatively large sized and that requires precision of the fitting portions of various units and the like, a molding process with gas assist is employed instead of the conventional molding process in which the whole frame is formed into thick walls by using low foaming material. This is intended to provide a constitution of non-uniform sections in which portions requiring strength and precision are of thicker walls, where the portions of non-uniform sections are made hollow so that inert gases such as nitrogen, carbon dioxide gas and air will be supplied to thereby ensure the strength and precision.

The concrete arrangement for applying the molding process with gas assist to the resin frame integrally made from ABS resin, polystyrene or other thermoplastic resins is as follows.

First, in order to mold the unit retaining portion having a generally U-shaped cross section for retaining the image processing unit, gas grooves 33*a* are provided by forming hollow portions that serve as passages for inert gas along the erection boundary portions between the base 28 and the side walls 29. Also, in order to improve the dimensional accuracy of the upper end portions of the side walls 29, to which the exposure optical unit 1 is to be fitted, gas grooves 33*b* are formed so as to be branched and extended from the gas grooves 33*a* in a longitudinally generally center portion of scanning course of the optical system. This gas groove 33*b*, if provided vertically in proximity to the engaging portion 31 formed in each unit retaining portion, serves also as a reinforcement of the engaging portion for retaining the image processing unit.

Further, gas grooves 33*c* are also formed in the plurality of pillar members 30 disposed at the other end of the base 28. The gas grooves may be provided either singly or by being branched and extended from the gas grooves 33*a*. When the legs 32 are integrally molded into the resin frame, gas grooves 33*d* are formed also at the boundary portions between the base 28 and the legs 32 in the same way as described above.

As described above, by providing gas grooves and their branched and extended portions in the molding process of the resin frame, the precision of the unit fitting portions on the peripheries can be ensured with the feed of inert gas, while the strength can be increased with the hollow structure.

In the image processing unit 2, the developing device 15, the photosensitive drum 11 and the cleaning device 17, among others, constitute a developing unit, as they are disposed generally vertically in this order. The developing unit is to be fitted from the left hand in FIG. 2 to the engaging portions 31 provided in the unit retaining portions with generally U-shaped cross sections of the resin frame. With the developing unit fitted, an optical image projected from the exposure optical system is applied onto the surface of the photosensitive drum 11 through the exposure slit 14.

Figure 4:
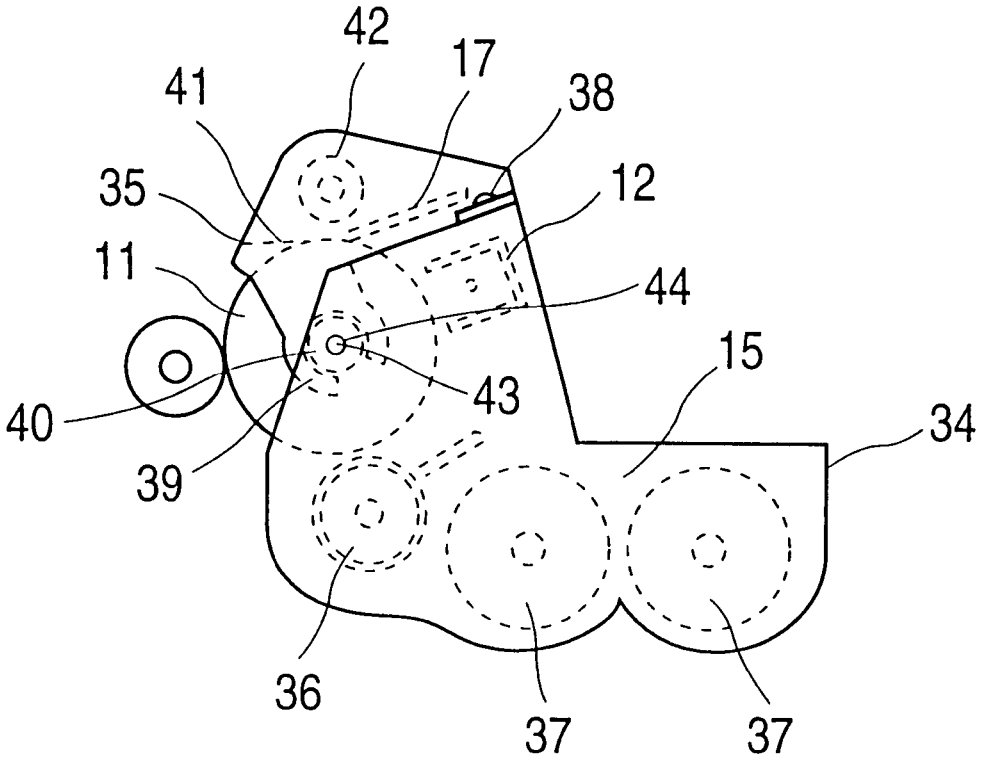
FIG. 4 is a side view for explaining the developing unit.

The developing unit is made up integrally from lower frame 34 and upper frame 35 as shown in FIG. 4, where the lower frame 34 is equipped with a magnet roll 36 and agitating blades 37 so that the developer within the developing device 15 will be agitated and turned, by which development is carried out in the developing section. Designated by numeral 38 is a mounting screw.

The photosensitive drum 11 and the cleaning device 17 are provided in the upper frame 35, where the photosensitive drum 11 is so arranged that a drum shaft 40 is retained by a drum retainer 39 formed in the upper frame 35. The frames, which are made from ABS or other resin material, are to be fitted by making use of elasticity of the resin material The photosensitive drum 11 can be fitted to the upper frame 35 by turning the upper frame 35 upside down and fitting the upper frame 35 to the photosensitive drum 11 from above.

Next, the retained drum shaft 40 is fitted by inserting a support pin 44 to a hole 43 provided in the lower frame 34 from outside of the frame, by which the drum side is retained at a specified position and set to a regular position with the cleaning device 17 and a toner receptor 41 pressed against the photosensitive drum 11.

Also in this upper frame 35, the toner receptor 41 and a recovery screw 42 are provided as well.

The recovery screw 42 is rotated with rotation of the photosensitive drum 11 so as to send out recovered toner on this side of the drawing, as viewed in the figure, and discharge into a separate recovery container.

Figure 5:
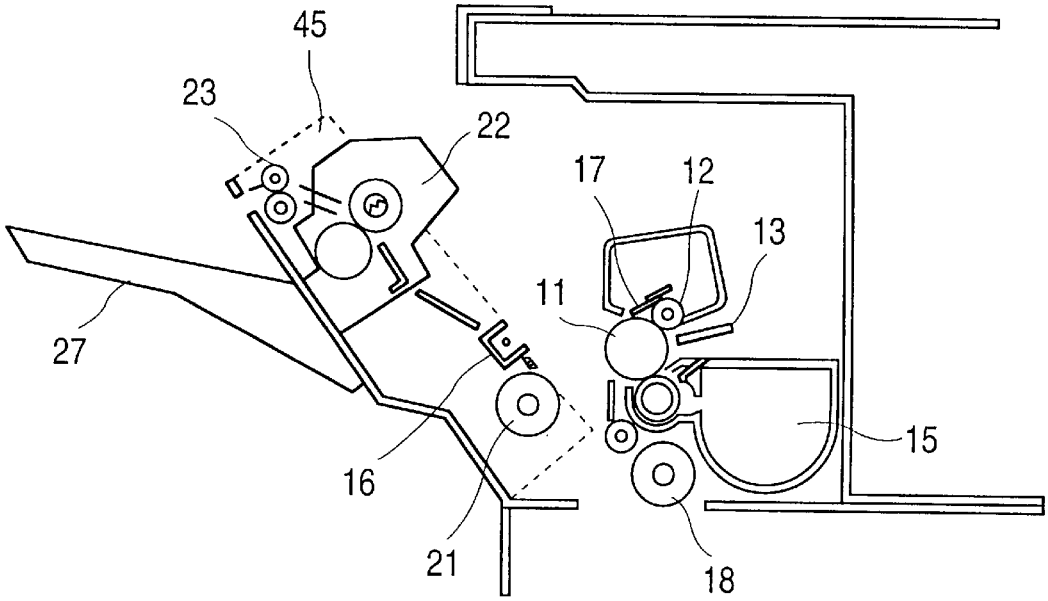
FIG. 5 is a sectional view showing a constitution in which the sheet conveyor unit is opened.
Figure 6:
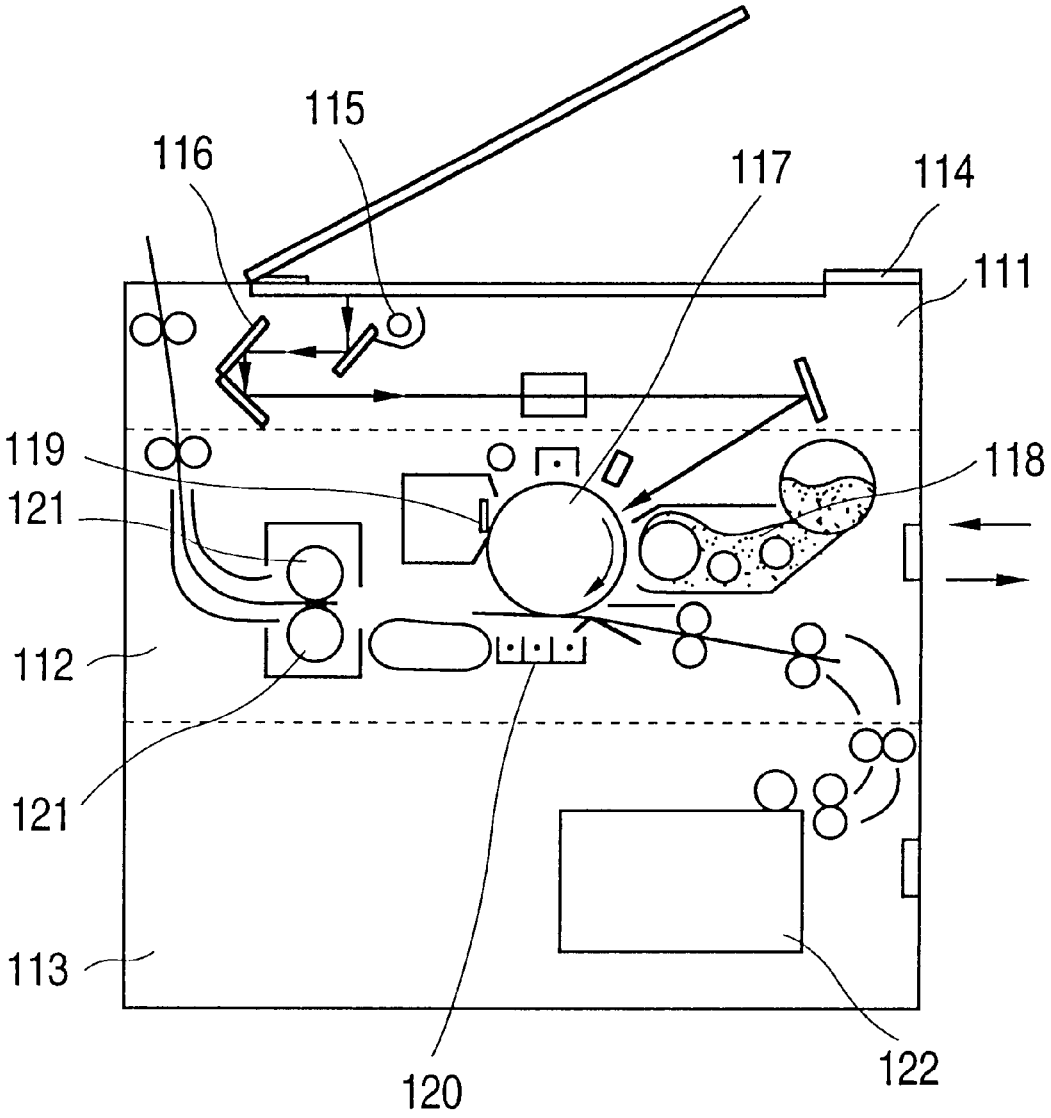
FIG. 6 is an explanatory view showing constitution of a conventional electrophotographic copying apparatus.
Figure 7:
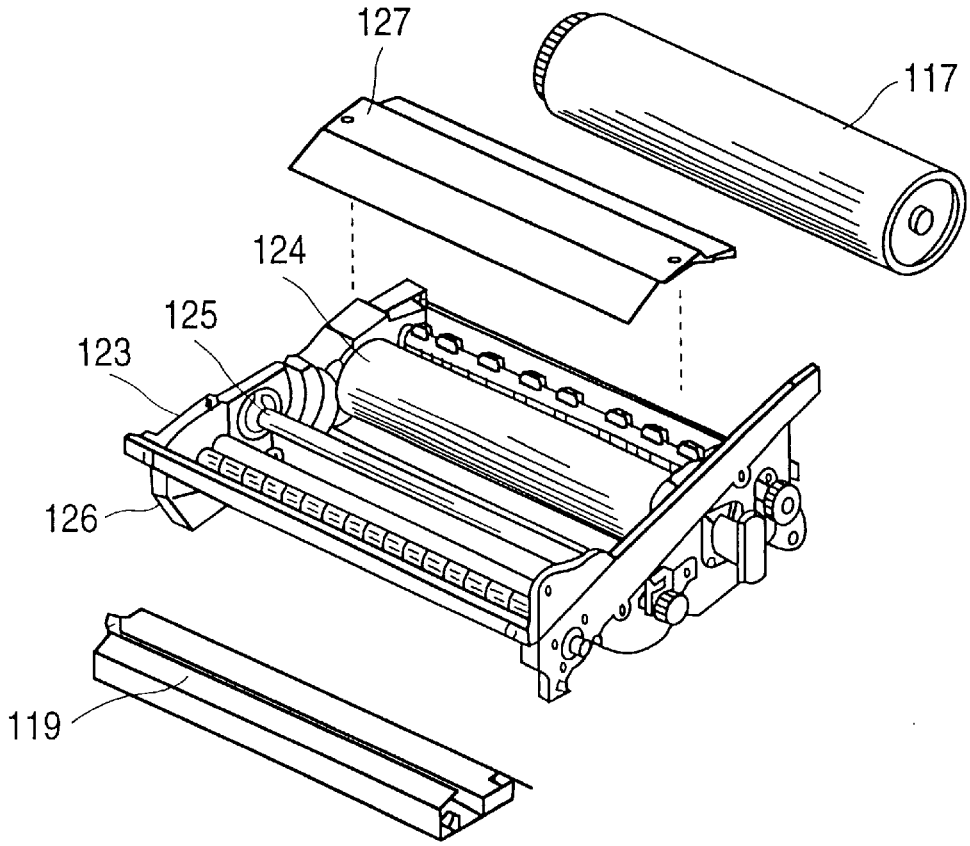
FIG. 7 is an exploded perspective view of a conventional developing unit.

The resin frame is equipped with an unshown hinge at the lower end, and a sheet conveyor unit 45 serving also as a cover is fitted so as to be openable and closable about this hinge as shown in FIG. 5. The sheet conveyor unit 45 is equipped with the transfer device 16 implemented by a corona charger and the fixing device 22 implemented by a heat roller, so that a sheet fed up from below, onto which a toner image formed on the photosensitive drum 11 will be transferred by the transfer device 16 and fixed by the fixing device 22 with heat and pressure, will then be discharged by the discharge roller 23.

Next, a second embodiment of the present invention is described with reference to FIGS. 8 to 11.

Figure 8:
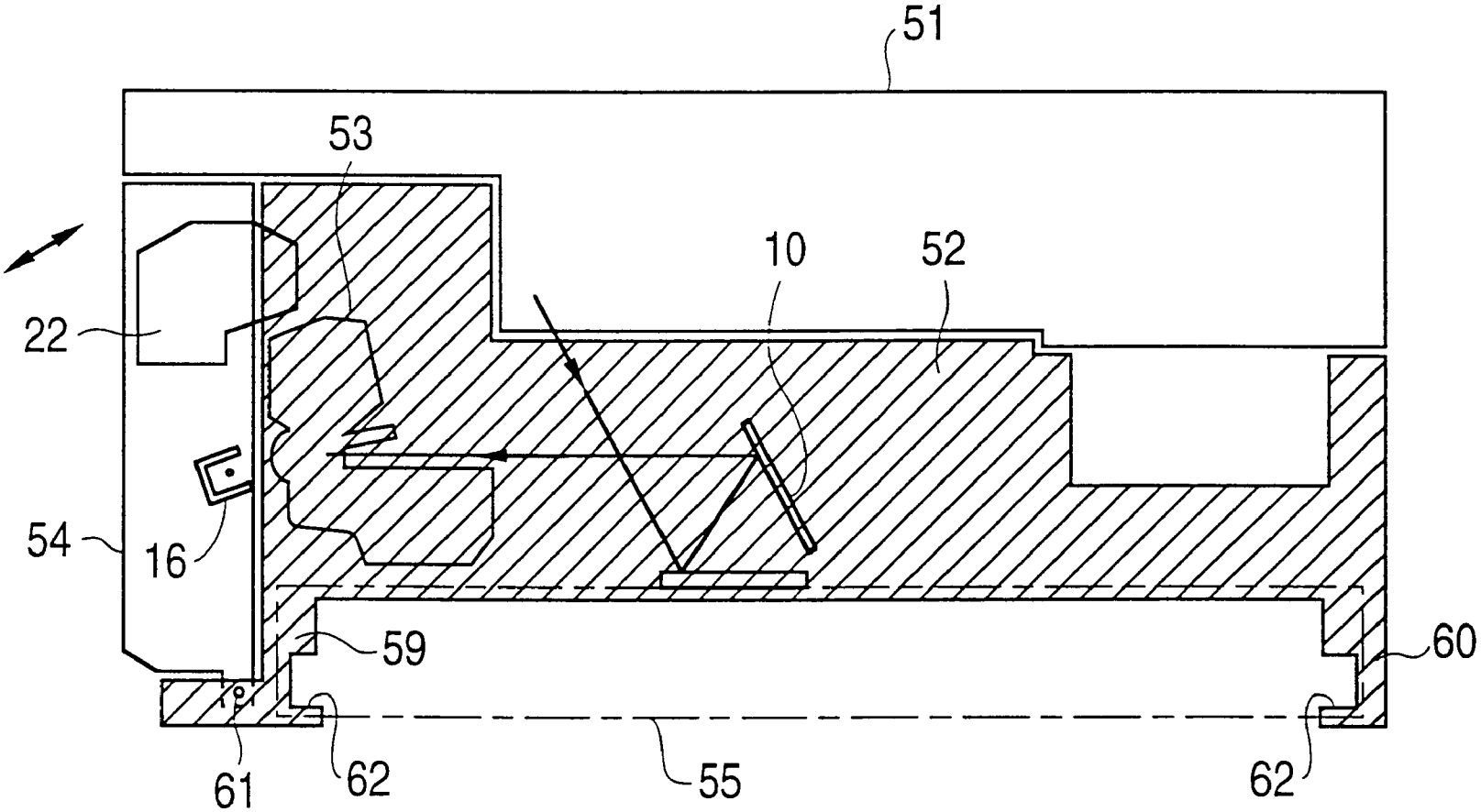
FIG. 8 is an overall schematic view in a second embodiment of the present invention.
Figure 9:
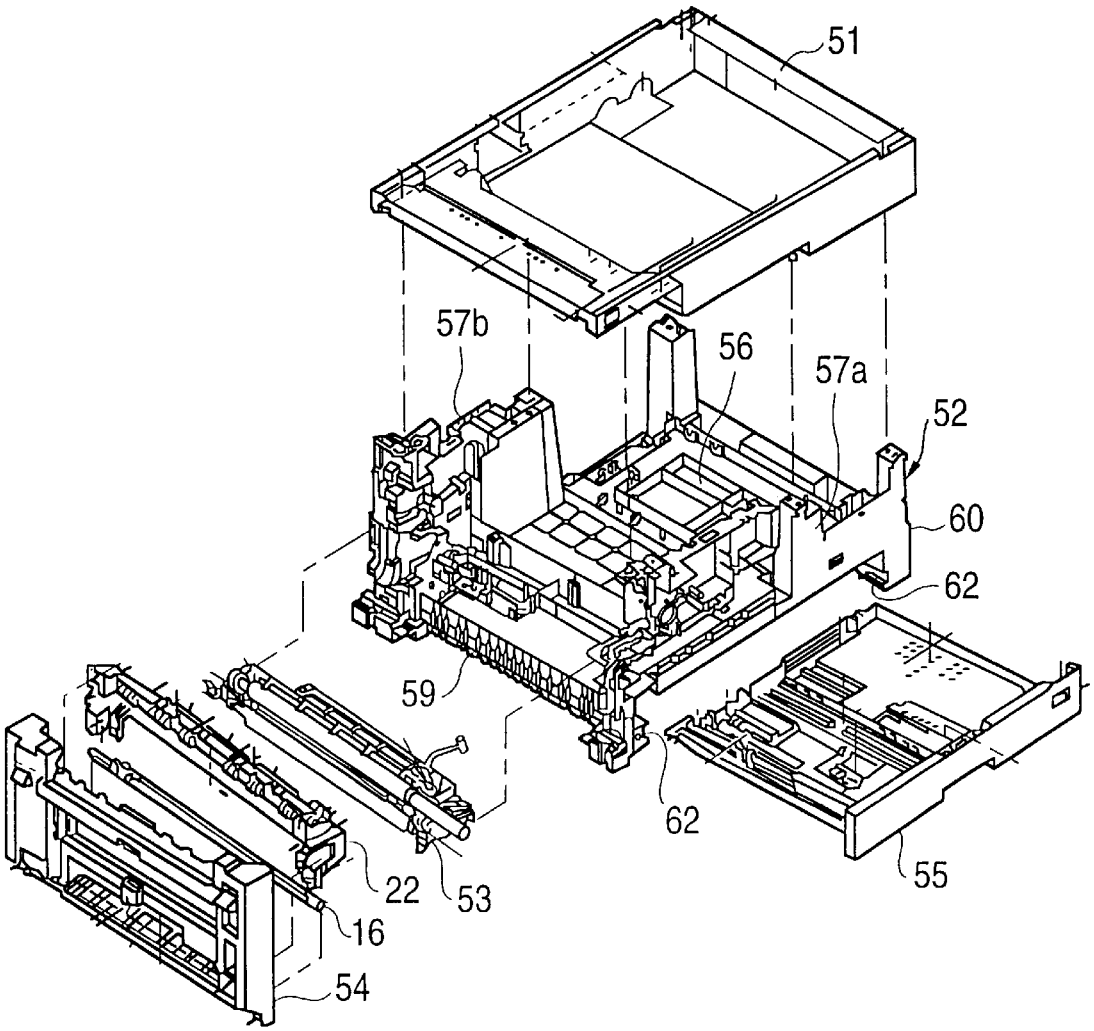
FIG. 9 is an exploded perspective view of the second embodiment.

Referring to FIGS. 8 and 9, reference numeral 51 denotes an exposure-optical-system-containing casing, which includes a platen glass 4, a lamp 5, a first reflecting mirror 6, second reflecting apparatus 7, a projection lens 8 and a third reflecting mirror 9, as described based on FIG. 1, and which is formed into the same configuration and structure as the casing of the exposure optical unit 1 shown in FIGS. 1 and 3. Numeral 52 denotes an apparatus body casing, which internally contains a fourth reflecting mirror 10 and a sheet feed roller 18 as described based on FIG. 1 and to which a developing unit 53 including a photosensitive drum 11, a charging device 12, a side eraser 13, an exposure slit 14, a developing means 16, a cleaning device 17 and the like are removably fitted. Designated by numeral 54 is an opening/closing casing, which includes a registration roller 21, a transfer device 16, a fixing device 22 and discharge rollers 23 as described based on FIGS. 1 and 5. Numeral 55 denotes a sheet feeder cassette.

Figure 10:
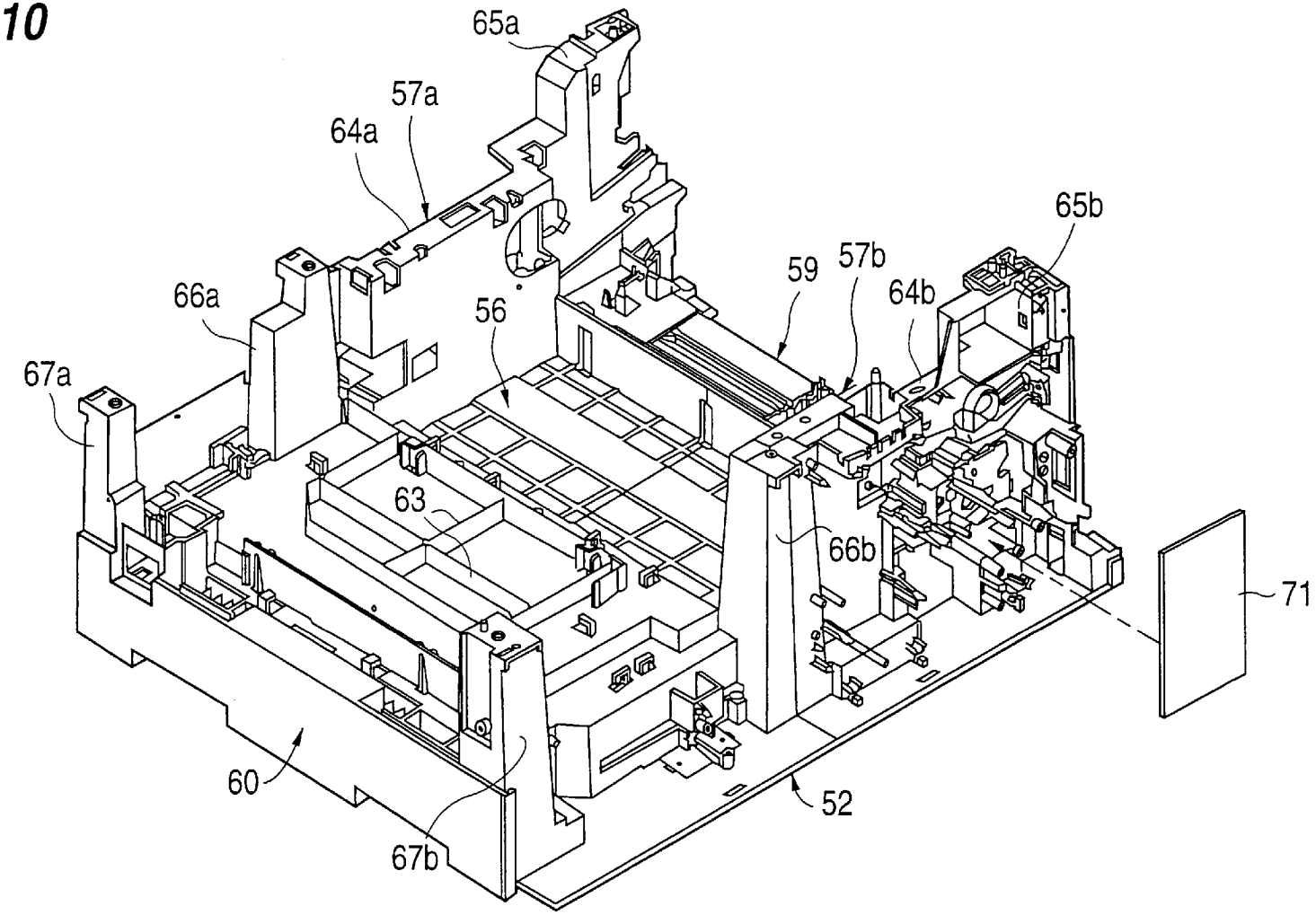
FIG. 10 is a perspective view of an apparatus body casing, as viewed obliquely from above.
Figure 11:
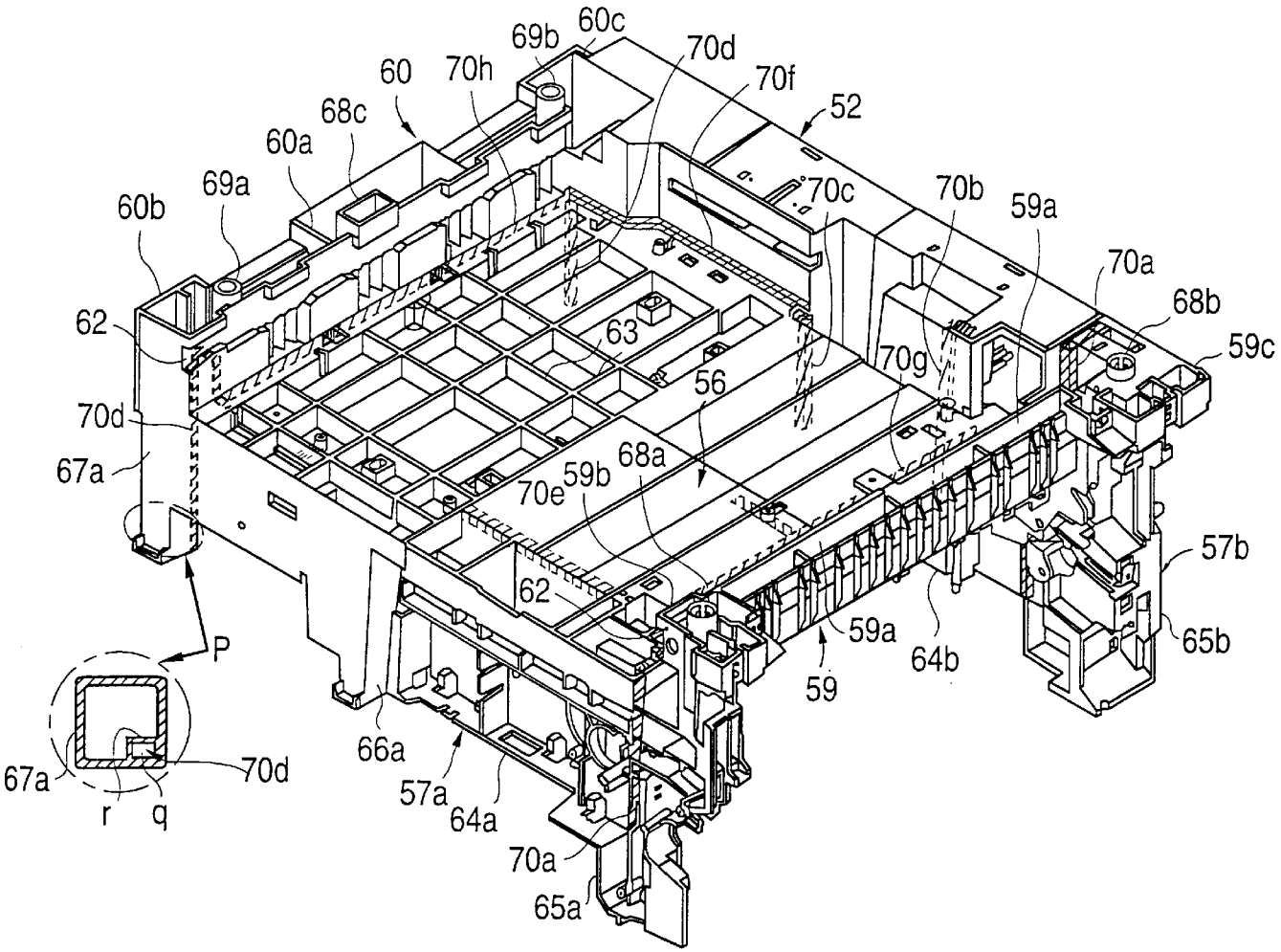
FIG. 11 is a perspective view of an apparatus body casing, as viewed obliquely from below.

The exposure-optical-system-containing casing 51, in which at least movable parts of the exposure optical system is contained, the apparatus body casing 52, and the sheet feeder cassette 55 are placed so as to be stacked from above to below, while an opening/closing casing 54 is placed in the front of the apparatus body casing 52. The apparatus body casing 52, as shown in FIGS. 9 to 11, has a base 56 (equivalent to the base 28 in FIG. 2), left and right side walls 57*a*, 57*b*, and front leg wall 59 and rear leg wall 60 (equivalent to the legs 32 in FIG. 2) projected downward from the front and rear sides. These component members are integrally molded resin. The exposure-optical-system-containing casing 51 is fitted to the upper end surfaces of the left and right side walls 57*a*, 57*b*, and lower end portion of the opening/closing casing 54 is pivotally supported to the front leg wall 59 by a hinge 61 (see FIG. 8) Also, the sheet feeder cassette 55 is insertably and removably fitted to guide grooves 62, 62 formed at inner peripheries of the front and rear leg walls 59, 60.

The base 56 of the apparatus body casing 52 has a multiplicity of reinforcing ribs 63 integrally formed on its upper and lower surfaces in a lattice shape, thus ensuring the rigidity while weight reduction is designed The left side wall 57*a* is formed into a hollow wall member 64*a* over about ⅔ of its range on the front side, a front end portion of which is a high wall portion 65*a* of a much taller hollow pillar shape, and a rear end portion of which is a hollow pillar portion 66*a*. The left side wall 57*a* also has a hollow pillar member 67*a* at its rear end portion. The right side wall 57*b* is formed into a hollow wall member 64*b* over about ⅔ of its range on the front side, the front end portion of which is a high wall portion 65*b* of a much taller hollow pillar shape, and a rear end portion of which is a hollow pillar portion 66*b*. The right side wall 57*b* also has a hollow pillar member 67*b* at its rear end portion.

As shown in FIG. 11, the front leg wall 59 of the apparatus body casing 52 has a plurality of hollow pillar portions 59*a*, both left and right ends of which are integrally coupled with downward projections 59*b*, 59*c* of the high wall portions 65*a*, 65*b*. Likewise, the rear leg portion 60 has a plurality of hollow pillar portions 60*a*, both left and right ends of which are integrally coupled with downward projections 60*b*, 60*c* of the hollow pillar members 67*a*, 67*b*.

A left-and-right pair of grounding protrusions 68*a*, 68*b* are integrally formed on the lower surface of the front leg wall 59 on both end portions thereof, and one grounding protrusion 68*c* is integrally formed in a center of the lower surface of the rear leg wall 60, so that the apparatus body casing 52 will be supported at three points by the grounding surface. Also, a left-and-right pair of auxiliary grounding protrusions 69*a*, 69*b* slightly smaller in protruding amount than the grounding protrusions 68*a*, 68*b*, 68*c* are integrally formed at positions in proximity to both end portions of the lower surface of the rear leg wall 60. In this way, supporting at three points the apparatus body casing 52, which is an integrally molded product of resin, makes it possible to solve the issue of unstable grounding due to distortions during the resin molding process still, providing a left-and-right pair of auxiliary grounding protrusions 69*a*, 69*b* makes it possible that even when external force largely acts on the apparatus body casing 52, the apparatus body casing 52 would result in only a slight tilt and recover the stability.

This embodiment also employs the resin molding process with gas assist, as in the first embodiment, to ensure the rigidity and strength of the apparatus body casing 52. Hatched portions 70*a* to 70*h* in FIG. 11 are gas grooves formed by this molding process. As apparent from the sectional view of a place indicated by P in FIG. 11, each of the gas grooves 70*a* to 70*h* includes a passage q through which inert gas passes in the molding process, and a peripheral wall portion r formed around this passage, so that, for example at the place P, one corner portion of the hollow pillar member 67*a* is reinforced from inside, and therefore the whole hollow pillar member 67*a* is reinforced. Referring to FIG. 11, 70*a*, 70*a* denote gas grooves which reinforce the high wall portions 65*a*, 65*b*; 70*b*, 70*b* denote gas grooves which reinforce center portions of the hollow wall members 64*a*, 64*b* (the gas groove which reinforces the center portion of the hollow wall member 64*a* located on this side of FIG. 11 is not shown); 70*c*, 70*c* denote gas grooves which reinforce the hollow pillar portions 66*a*, 66*b* (the gas groove which reinforces the hollow pillar portion 66*a* located on this side of FIG. 11 is not shown); 70*d*, 70*d* denote gas grooves which reinforce the hollow pillar members 67*a*, 67*b*; 70*e* denotes a gas groove which is provided at a boundary portion between the base 56 and the left side wall 57*a* to reinforce this boundary portion; 70*f* denotes a gas groove which is provided at a boundary portion between the base 56 and the right side wall 57*b* to reinforce this boundary portion; 70*g* denotes a gas groove which is provided at a boundary portion between the base 56 and the front leg wall 59 to reinforce this boundary portion; and 70*h* denotes a gas groove which is provided at a boundary portion between the base 56 and the rear leg wall 60 to reinforce this boundary portion.

As shown above, the apparatus body casing 52 has the reinforcing ribs 63 formed on the base 56, the left and right side walls 57*a*, 57*b* and the front and rear leg walls 99, 60 composed of a plurality of hollow pillared portions 65*a*, 65*b*, 66*a*, 66*b*, 67*a*, 67*b*, 59*a*, 59*b*, 59*c*, 60*a*, 60*b*, 60*c*, and moreover the gas grooves 70*a* to 70*h*. Thus, the apparatus body casing 52, although being an integrally molded product of resin, has enough rigidity and strength to keep its shape sufficiently even if the exposure-optical-system-containing casing 51, which is a weighty article, is placed thereon and a multiplicity of internal components are equipped therein.

In addition, in this embodiment, as shown in FIG. 10, in conjunction with the fact that the apparatus body casing 52 is formed from resin to have electrically insulating property, a high-voltage power supply board 71 is directly mounted to the right side wall 57*b*. Thus, the need of interposing some insulating member between the high-voltage power supply board and the side wall, which would be involved in the case of conventional metallic casings, can be eliminated in this embodiment.

As described in detail above, in the present invention, the sheet feeder section, the image processing unit and the fixing-and-discharge section are arranged generally vertically in this order from below to constitute an image processing and conveyance unit, in such a way that the top of the vertically arranged image processing and conveyance unit is located in a region which is below the region of scanning by the first reflecting apparatus of the exposure optical unit and which is out of the scanning by the second reflecting apparatus. Thus, the whole apparatus can be made compact.

This arrangement also allows completed copies to be discharged nearby the document placed for copying, so that an electrophotographic copying apparatus which is easy to confirm the performance of copying and convenient to use can be offered. Moreover, with the vertical arrangement of the image processing and conveyance unit, the electrophotographic copying apparatus is reduced in the conveyance distance of sheets, as compared with conventional copying apparatuses in which the sheet is conveyed horizontally, so that the electrophotographic copying apparatus can be reduced in the time taken from the copying start until the copying completion.

Furthermore, the integral resin frame is formed into a construction with non-uniform sections of thick walls requiring strength and precision as well as into a hollow construction so that the molding process with gas assist can be applied to the resin frame. Therefore, as compared with conventional molding process by using low-foaming material, a resin frame having a greater effect of weight reduction can be made, each unit becomes easy to mount, and an electrophotographic copying apparatus of high precision as a whole can be realized. Further, the gas grooves make the resin material better in fluidity during the molding process, so that the injection pressure of resin can be reduced, so that distortions due to residual stress of injection remaining in the resin frame, which is a molded product, can be prevented, and so that the dimensional accuracy can be enhanced. Moreover, both the molding machine and the molding dies can be downsized by virtue of the reduction in injection pressure. In the case where the apparatus body casing is supported at three points, the issue of unstable grounding due to distortions during the resin molding process can be solved. Further, the high-voltage power supply board can be mounted directly to the side wall of the apparatus body casing which is integrally molded of resin, so that the construction can be simplified, and like this, a variety of functional effects can be obtained.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom

We claim:

1. An electrophotographic copying apparatus for use with a document to be copied comprising:

a document plate glass for placing thereon the document to be copied;

an exposure optical unit including: a first reflecting apparatus disposed below the document plate glass and operable to scan the document placed on said document plate glass by moving from one end side to the other end side of said document plate glass at a speed; a second reflecting apparatus placed in a region ranging from below a generally central portion of said document plate glass to below the other end side of said document plate glass such that said second reflecting apparatus will not hinder said first reflecting apparatus from scanning, and operable to move at a speed ½ that of the speed of said first reflecting apparatus; a lens operable to project an image of the document scanned by said first and second reflecting apparatuses; and a reflecting mirror operable to bend downward the image of the document that has passed through said lens;

an image processing unit including a photosensitive drum, and a charging device, an exposure slit, a developing device, a transfer device, and a cleaning device, provided around said photosensitive drum so as to visualize an optical image projected from said lens and to copy the image onto a sheet, wherein said lens is operable to project the image onto said photosensitive drum and said reflecting mirror is operable to lead the image to said photosensitive drum a sheet feeder section operable to feed a sheet to said transfer device of said image processing unit, said sheet feeder section including a sheet feeder cassette; and a fixing-and-discharge section operable to fix and discharge the sheet from said image processing unit and onto which the document image has been transferred; and an image processing and conveyance unit including said image processing unit placed above one end of said sheet feeder cassette of said sheet feeder section so that sheets will be fed to said transfer device of said image processing unit one by one from said sheet feeder section upward and in a direction generally perpendicular to surfaces of sheets accommodated in said sheet feeder cassette, and including said fixing-and-discharge section placed above said image processing unit so that the sheet discharged upward from said image processing unit will be fixed and discharged;

wherein a top portion of said image processing and conveyance unit is located below a region of scanning by said first reflecting apparatus of said exposure optical unit and outside of a region of scanning by said second reflecting apparatus and which is adjacent to said reflecting mirror so that the sheet will be discharged from said image processing and conveyance unit to a proximity of the document placed on said document plate glass;

wherein said first and second reflecting apparatuses start a scan in a positional relationship such that said first and second reflecting apparatuses are away from each other on one end side and a center region of said document plate glass, respectively, and terminate the scan at a scanning end point on the other end side of said document plate glass in a positional relationship such that said first and second reflecting apparatuses are close to each other at the other end side of said document plate glass;

wherein said electrophotographic copying apparatus further comprises:

unit retaining portions which are erected on both sides of one end of a base and each have an engaging portion formed to retain said image processing unit and which have a generally U shape in cross section; and an integral resin frame in which a plurality of pillar portions are disposed on the other end of said base; and gas grooves having, in an interior thereof, passages of inert gas for molding with gas assist, provided at boundary portions between said unit retaining portions, each gas groove having a generally U shape in cross section formed of said resin frame and said base, said gas grooves extending and branching to said plurality of pillar portions disposed at the other end of said base, wherein said unit retaining portions and said pillar portions have upper end portions, respectively, molded with higher dimensional accuracy than other portions by molding said unit retaining portions and said pillar portions thicker in walls than the other portions and hollow and by feeding thereinto inert gas with use of said gas grooves during molding processes;

and wherein said image processing unit is mounted to said unit retaining portions of said resin frame, and said exposure optical unit is mounted to upper end portions of said unit retaining portions and upper end portions of said pillar portions in said resin frame.

2. The electrophotographic copying apparatus according to claim 1, wherein at least one of said gas grooves is branched and extended vertically in proximity to said engaging portion of at least one of said unit retaining portions, said at least one of said gas grooves being provided at boundary portions between said at least one of said unit retaining portions and said base.

3. The electrophotographic copying apparatus according to claim 2, further comprising leg portions integrally extending from said base in a direction opposite to said unit retaining portions; and further gas grooves, having in their interior, passages of inert gas for molding with gas assist, provided at boundary portions between said base and said leg portions.

4. The electrophotographic copying apparatus according to claim 1, further comprising leg portions integrally extending from said base in a direction opposite to said unit retaining portions; and further gas grooves, having in their interior, passages of inert gas for molding with gas assist, provided at boundary portions between said base and said leg portions.

5. The electrophotographic copying apparatus according to claim 1, further comprising:

an exposure-optical-system-containing casing containing at least a movable part of said exposure optical unit, an apparatus body casing to which said image processing unit is removably fitted, and a sheet feeder cassette, arranged so as to be stacked from above to below; and an opening/closing casing in which said transfer device and said fixing-and-discharge section are disposed in a fore of said apparatus body casing;

wherein said apparatus body casing has an apparatus body casing base, left and right side walls, and front and rear leg walls projected downward from front and rear sides, said apparatus body casing base, left and right side walls, and front and rear leg walls being integrally molded of resin;

and wherein said exposure-optical-system-containing casing is mounted to upper end surfaces of said left and right side walls, a lower end portion of said opening/closing casing is pivotally supported to said front leg wall, and said sheet feeder cassette is insertably and removably accommodated in gas grooves formed at inner peripheries of said front and rear leg walls.

6. The electrophotographic copying apparatus according to claim 5, wherein said left and right side walls and front and rear leg walls of said apparatus body casing each have a plurality of hollow pillar portions, and said base has a multiplicity of reinforcing ribs.

7. The electrophotographic copying apparatus according to claim 6, further comprising:

a left-and-right pair of grounding protrusions formed in a lower surface of one of said front and rear leg walls; and one grounding protrusion formed in a center of a lower surface of the other of said front and rear leg walls;

wherein said apparatus body casing is supported at three points by a grounding surface.

8. The electrophotographic copying apparatus according to claim 6, further comprising a high-voltage power supply board mounted directly on one side wall of said apparatus body casing.

9. The electrophotographic copying apparatus according to claim 5, further comprising:

a left-and-right pair of primary grounding protrusions formed in a lower surface of one of said front and rear leg walls; and one primary grounding protrusion formed in a center of a lower surface of the other of said front and rear leg walls;

wherein said apparatus body casing is supported at three points by a grounding surface.

10. The electrophotographic copying apparatus according to claim 9, further comprising auxiliary grounding protrusions, slightly smaller in protruding amount than said primary grounding protrusions, provided on both sides of said one primary grounding protrusion in the lower surface of the other of said front and rear leg walls.

11. The electrophotographic copying apparatus according to claim 10, further comprising a high-voltage power supply board mounted directly on one side wall of said apparatus body casing.

12. The electrophotographic copying apparatus according to claim 9, further comprising a high-voltage power supply board mounted directly on one side wall of said apparatus body casing.

13. The electrophotographic copying apparatus according to claim 5, further comprising a high-voltage power supply board mounted directly on one side wall of said apparatus body casing.

* * * * *